US006266427B1

(12) United States Patent
Mathur

(10) Patent No.: US 6,266,427 B1
(45) Date of Patent: Jul. 24, 2001

(54) DAMPED STRUCTURAL PANEL AND METHOD OF MAKING SAME

(75) Inventor: Gopal P. Mathur, Mission Viejo, CA (US)

(73) Assignee: McDonnell Douglas Corporation, Seal Beach, CA (US)

( * ) Notice: Subject to any disclaimer, the term of this patent is extended or adjusted under 35 U.S.C. 154(b) by 0 days.

(21) Appl. No.: 09/100,427

(22) Filed: Jun. 19, 1998

(51) Int. Cl.[7] ..... H04R 25/00

(52) U.S. Cl. ..... 381/353; 381/423; 381/426; 181/167; 181/172; 181/284

(58) Field of Search ..... 381/423, 426, 381/431, 184, 71.1, 71.2, 71.3, 71.4, 71.7, 398, 427, 428, FOR 162, FOR 153; 181/151, 166, 173, 208, 284, 288, 290, 167, 171, 172, 207, 210, 286; 244/123, 119, 1 N, 124, 126

(56) References Cited

U.S. PATENT DOCUMENTS

| | | | | |
|---|---|---|---|---|
| 3,160,549 | | 12/1964 | Caldwell et al. . | |
| 3,976,269 | * | 8/1976 | Sen Gupta | 244/119 |
| 4,011,356 | | 3/1977 | Lambert et al. . | |
| 4,068,736 | | 1/1978 | Dean et al. . | |
| 4,143,495 | | 3/1979 | Hintz . | |
| 4,235,302 | * | 11/1980 | Tsukamoto . | |
| 4,387,786 | | 6/1983 | Klipsch et al. . | |
| 4,416,349 | * | 11/1983 | Jacobs | 181/208 |
| 4,635,882 | * | 1/1987 | SenGupta et al. | 244/119 |
| 4,741,945 | | 5/1988 | Brant et al. . | |
| 4,828,202 | * | 5/1989 | Jacobs et al. | 244/123 |
| 4,924,969 | | 5/1990 | L'Heureux . | |
| 5,251,849 | | 10/1993 | Torres . | |
| 5,280,991 | | 1/1994 | Welland . | |
| 5,823,467 | * | 10/1998 | Mathur | 244/1 N |
| 5,862,242 | * | 1/1999 | Takewa et al. | 381/398 |
| 5,904,318 | * | 5/1999 | Towfig | 244/1 N |
| 6,031,917 | * | 2/2000 | Mathur | 381/71.11 |

FOREIGN PATENT DOCUMENTS

| | | | | |
|---|---|---|---|---|
| 1-130699 | * | 5/1989 | (JP) | 381/398 |

OTHER PUBLICATIONS

Preston W. Smith, Jr. et al., "Sound And Structural Vibration," NASA Contract Report, NASA CR–160, Mar. 1965, pp. 173–189, Cambridge, Mass.

Gideon Maidanik, "Response of Ribbed Panels to Reverberant Acoustical Fields," The Journal of the Acoustic Society of America, Jun. 1962, pp. 809–826, vol. 34, No. 6.

Frank Fahy, "Sound and Structural Vibration, Radiation, Transmission and Response," Institute of Sound and Vibration Research, The University Southampton, England, 1985, pp. 60–89, Academic Press.

H. Peng et al, "Sound Radiation From Finite Plates Under The Action of Multiple Random Point Forces," J. Acoust. Soc. Am., Jan. 1989, pp. 57–67, vol. 85, No. 1, Acoustical Society of America.

* cited by examiner

*Primary Examiner*—Curtis Kuntz
*Assistant Examiner*—T. Dabney
(74) *Attorney, Agent, or Firm*—Brooks & Kushman P.C.

(57) ABSTRACT

A damped structural panel includes a panel having bending modes including demanding bending modes. The demanding bending modes have subsonic bending waves along at least one axis, and require damping treatment based on sound radiation properties of the panel. A viscoelastic material is applied within a limited area adjacent to the panel edges based on the demanding bending modes. The viscoelastic material damps sound radiation caused by bending waves during use of the structural panel, such as use as a body panel on an aircraft.

12 Claims, 3 Drawing Sheets

DAMPED STRUCTURAL PANEL AND METHOD OF MAKING SAME

TECHNICAL FIELD

The present invention relates to damped structural panels and methods of making damped structural panels.

BACKGROUND ART

Structural panels such as aircraft fuselage panels, panels of automobiles, panels found on machinery, and panels found in household appliances, typically radiate noise due to vibratory motion induced in the panels. The resonant vibrations of the structural panels are often induced by unavoidable external sources. For example, engines, motors, compressors, etc., may induce vibrations in panels. Noise problems with structural panels are more apparent when panel thickness is reduced to minimize panel weight, such as in aircraft fuselage panels and other aerospace applications.

One known technique frequently employed to reduce resonant vibrations in structural panels is the use of viscoelastic damping treatments. In free-layer type damping treatments, a viscoelastic damping material, such as rubber, is added as a free layer to the surface of the structural panel. The damping treatment is usually applied to the entire surface of the panel. The viscoelastic material absorbs a portion of the total vibration energy by shear deformation. A more effective damping technique is to cover the free layer of viscoelastic material with a constraining layer of metal to form a constrained-layer type damping treatment. The addition of the constraining layer on top of the free layer improves the energy absorption characteristics of the damping layer.

Although the conventional damping treatments provide increased damping for resonant modes of the structural panel, the large amounts of viscoelastic material which are used to cover the entire surface of the structural panel are expensive and heavy. These conventional damping treatments are particularly disadvantageous for aerospace applications or any other applications in which thin, light panels are desired.

DISCLOSURE OF INVENTION

It is, therefore, an object of the present invention to provide a damped structural panel having reduced weight, while sufficiently damping sound radiation caused by bending waves during use of the structural panel.

It is another object of the present invention to provide an improved damped structural panel having reduced amounts of viscoelastic material required for effective damping.

In carrying out the above objects and other objects and features of the present invention, a damped structural panel is designed. The damped structural panel comprises a panel having bending modes including demanding bending modes which radiate sound more efficiently. These demanding bending modes have subsonic bending waves along at least one axis, and require damping treatment based on sound radiation properties of the panel. A viscoelastic material is applied within a limited area adjacent to the panel edges based on the demanding bending modes. The viscoelastic material damps sound radiation caused by bending waves in the demanding bending modes. The viscoelastic material may be applied at corners of the panel, along a plurality of the panel edges, or along all of the panel edges, depending on the panel configuration, design constraints, expected excitation frequencies, and desired damping characteristics.

Preferably, the panel has a thickness sized such that a first bending mode of the panel has a natural frequency of less than about 50 Hertz. Further, the panel is configured such that a coincidence frequency of the panel is at least about 6,000 Hertz. The limited area adjacent to the panel edges, within which the viscoelastic material is applied, is preferably defined by maximum wavelengths for bending waves normal to the panel edges in the demanding bending modes. The limited area extends inwardly from each panel edge for at least about one-fourth of the maximum wavelength for the bending waves normal to that panel edge.

Further, in carrying out the present invention, an aircraft comprising a body composed of structural panels, wings, and a thrust device is provided. At least one of the body structural panels includes a panel having viscoelastic material applied within a limited area adjacent to the panel edges to damp sound radiation caused by bending waves in demanding bending modes of the panel during operation of the aircraft.

Still further, in carrying out the present invention, a method of making a damped structural panel is provided. The method comprises forming a panel having bending modes including demanding bending modes which have subsonic bending waves along at least one axis, and which require damping treatment. The method further comprises determining a limited area adjacent to the panel edges based on the demanding bending modes, and applying a viscoelastic material within the limited area to damp sound radiation caused by bending waves in the demanding bending modes.

The advantages accruing to the present invention are numerous. For example, embodiments of the present invention provide damped structural panels having reduced weight and thickness, and requiring reduced amounts of viscoelastic material while sufficiently damping sound radiation caused by bending waves during use of the structural panel.

While embodiments of this invention are illustrated and disclosed, these embodiments should not be construed to limit the claims. It is anticipated that various modifications and alternative designs may be made without departing from the scope of this invention.

BEST MODES FOR CARRYING OUT THE INVENTION

Figure 1:
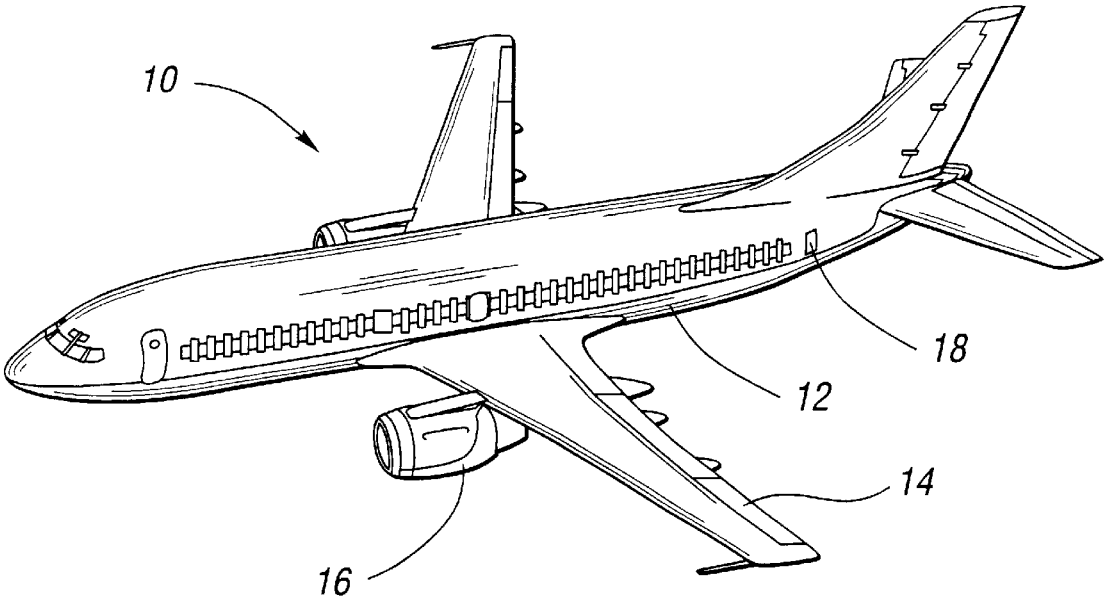
FIG. 1 is an aircraft of the present invention having a body composed of damped structural panels.

With reference to FIG. 1, an aircraft is generally indicated at 10.

Aircraft 10 includes a fuselage 12 and a pair of wings 14 connected to the fuselage 12 for providing lift. A plurality of turbines engines 16 serve as thrust devices for providing driving force during operation of the aircraft 10. The aircraft fuselage 12, or body, is composed of many structural panels, such as structural panel 18, supported by a frame including stiffening members at the panel edges.

Figure 2:
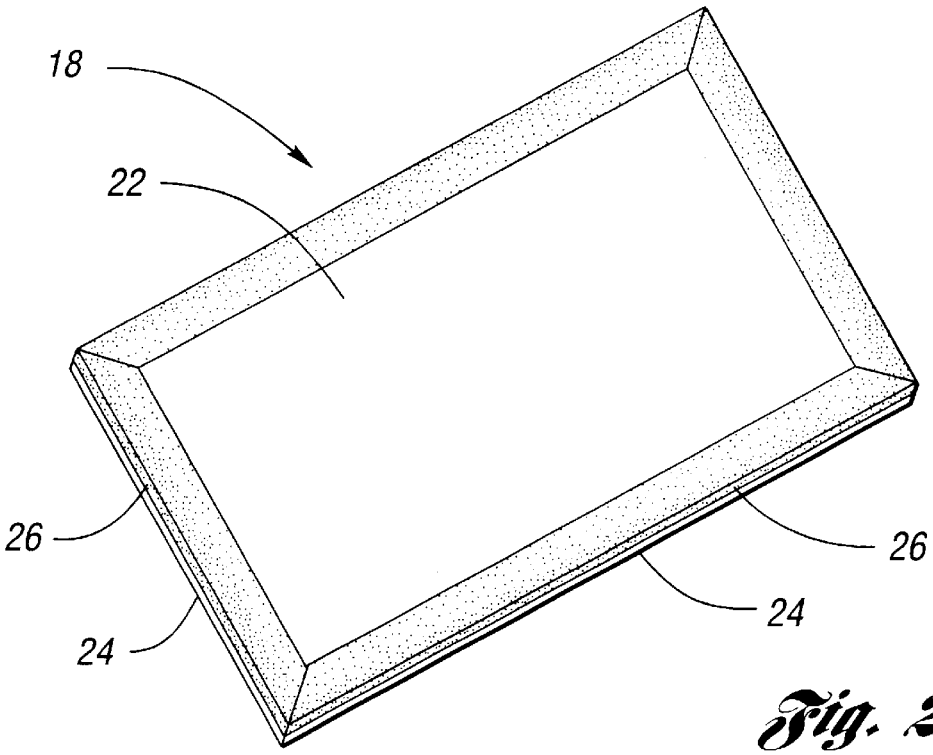
FIG. 2 is a body structural panel of the aircraft of FIG. 1, showing the viscoelastic material applied within the limited area adjacent to the panel edges.

As best shown in FIG. 2, structural panel 18 includes a panel body 22 which is generally rectangular in shape, and has outer edges 24. Viscoelastic material 26 is applied within a limited area adjacent to the panel edges 24. The viscoelastic material 26 damps sound radiation caused by bending waves in panel 18 during operation of the aircraft 10. Although panel 18 is illustrated as having a generally rectangular shape, it is to be appreciated that various other planar and non-planar panel shapes may be constructed in accordance with the present invention. Further, it is to be appreciated that in addition to aircraft fuselage panels, panels of automobiles, panels found on machinery, panels found in household appliances, and other structural panels may be constructed in accordance with the present invention.

To facilitate an understanding of the present invention, structural panel vibrations will be described in a planar, two-dimensional, structural panel. However, it is to be appreciated that more complex modeling may be employed to more precisely model the structural panels, such as a three-dimensional system which may model panel curvature.

A structural panel resonates at a number of different frequencies. Each of these frequencies corresponds to a particular bending mode. The mode shapes of the structural panel in two dimensions are described by the set of shape functions:

$$w_{mn}(x,y)=\sin(m\pi x)\sin(n\pi y),\ m=1,2,\ldots,\ n=1,2,\ldots$$

The first bending mode typically corresponds to the indices m=n=1, due to the fixed boundary conditions of most installed structural panels which are bound by stiffening members at panel edges. The first bending mode, $w_{11}$, occurs at frequency $\omega_{11}$. Other bending modes occur thereafter, at increased frequencies. At the lower frequency bending modes, bending waves in the X-direction and bending waves in the Y-direction are subsonic. Subsonic bending waves have a phase velocity which is less than the speed of sound in the surrounding medium. Because the pressure waves in the surrounding medium travel faster than the subsonic bending waves in both the x-direction and y-direction, the pressure waves severely attenuate each other everywhere except for quarter wavelengths at the corners of the panel.

Supersonic bending waves have a phase velocity which is greater than the speed of sound in the surrounding medium. When the bending waves along one axis are supersonic, and the bending waves along the other axis are subsonic, the panel edges parallel to the supersonic bending waves have uncanceled quarter wavelengths which radiate sound.

When the bending waves along both axes are supersonic, the entire panel surface radiates sound. The frequency at which the bending waves along both axes become supersonic is known as the coincidence frequency. Embodiments of the present invention provide damping for excitation frequencies below the coincidence frequency. Attenuations of pressure waves in the different bending modes below the coincidence frequency will now be described.

Figure 3:
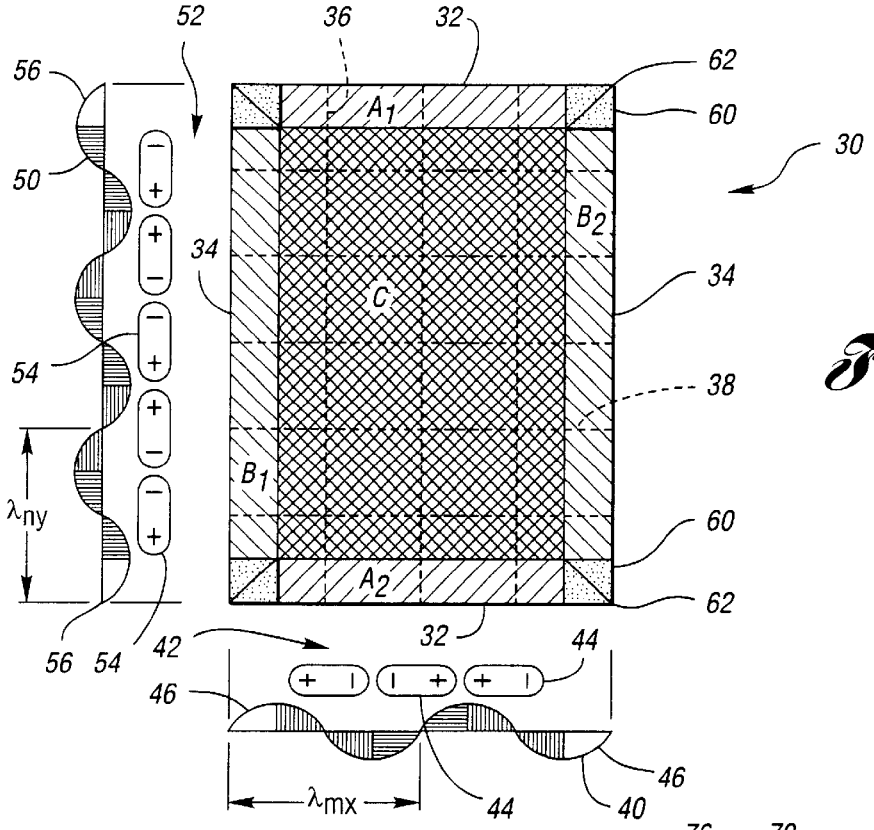
FIG. 3 is a schematic view of a damped structural panel of the present invention, illustrating a subsonic bending wave in the X-direction, and a subsonic bending wave in the Y-direction.

With reference to FIG. 3, a generally rectangular structural panel is bounded in the Y-direction by edges 32, and is bounded in the X-direction by edges 34. The panel 30 is shown in bending mode $w_{mn}$ and the mode shape is indicated by Y-direction node lines 36 and X-direction node lines 38. X-direction bending waves 40 have a wavelength $\lambda_{mx}$, and a frequency of $\omega_{mn}$ corresponding to the bending mode $w_{mn}$. In the exemplary bending mode illustrated, m=4 and n=6. Positive and negative pressure variations due to bending wave 40 are generally indicated at 42. The X-direction bending wave 40 is depicted as subsonic, that is, having a phase velocity which is less than the speed of sound through the surrounding medium. Adjacent positive and negative pressure pulses form pressure pulse pairs 44 which substantially cancel before the bending wave 40 undergoes a 180° phase shift to radiate the pressure waves. The pressure pulse pairs 44 are substantially canceled throughout regions $A_1$, $A_2$, and C. The cancellation significantly attenuates noise from all anti-nodes defined by Y-direction node lines 36 and X-direction node lines 38 within regions $A_1$, $A_2$, and C. However, the quarter wavelengths 46 of bending wave 40 at either X-boundary edge 34, outside regions $A_1$, $A_2$, and C, are not canceled prior to the 180° phase shift, resulting in pressure wave propagation from a portion of the panel surface area about quarter wavelength 46.

Similarly, Y-direction bending wave 50 has a wavelength $\lambda_{ny}$ and a frequency of $\omega_{mn}$ corresponding to the bending mode $w_{mn}$. Y-direction bending wave 50 is depicted as subsonic. Positive and negative pressure variations, generally indicated at 52, caused by Y-direction bending wave 50 also substantially cancel in a plurality of pressure pulse pairs 54. The pressure pulse pairs 54 are substantially canceled throughout regions $B_1$, $B_2$, and C. The cancellation significantly attenuates noise from all anti-nodes defined by Y-direction node lines 36 and X-direction node lines 38 within regions $B_1$, $B_2$, and C. However, the quarter wavelengths 56 of bending wave 50 at either Y-boundary edge 32, outside regions $B_1$, $B_2$, and C, are not canceled prior to the 180° phase shift, resulting in pressure wave propagation from a portion of the panel surface area about quarter wavelength 56.

Together, the X-direction bending wave 40 and the Y-direction bending wave 50 severely attenuate all pressure variations about the panel surface, except for the corners 62 outside of regions $A_1$, $A_2$, $B_1$, $B_2$, and C. Thus, embodiments of the present invention appreciate that sound radiation from mechanically excited structural panels is mostly due to uncanceled quarter wavelengths along the panel comers 62, when both the X-direction and Y-direction bending waves are subsonic.

In accordance with the present invention, viscoelastic material 60 is applied within a limited area at comers 62 of the panel 30 to damp sound radiation when both the X-direction and Y-direction bending waves are subsonic. Such bending modes are called comer modes. It is to be understood that bending mode $w_{46}$ is shown for exemplary purposes and that panel 30 may be configured such that a number of different bending modes are comer modes, and that $w_{46}$ may or may not be included as one of those modes.

Figure 4:
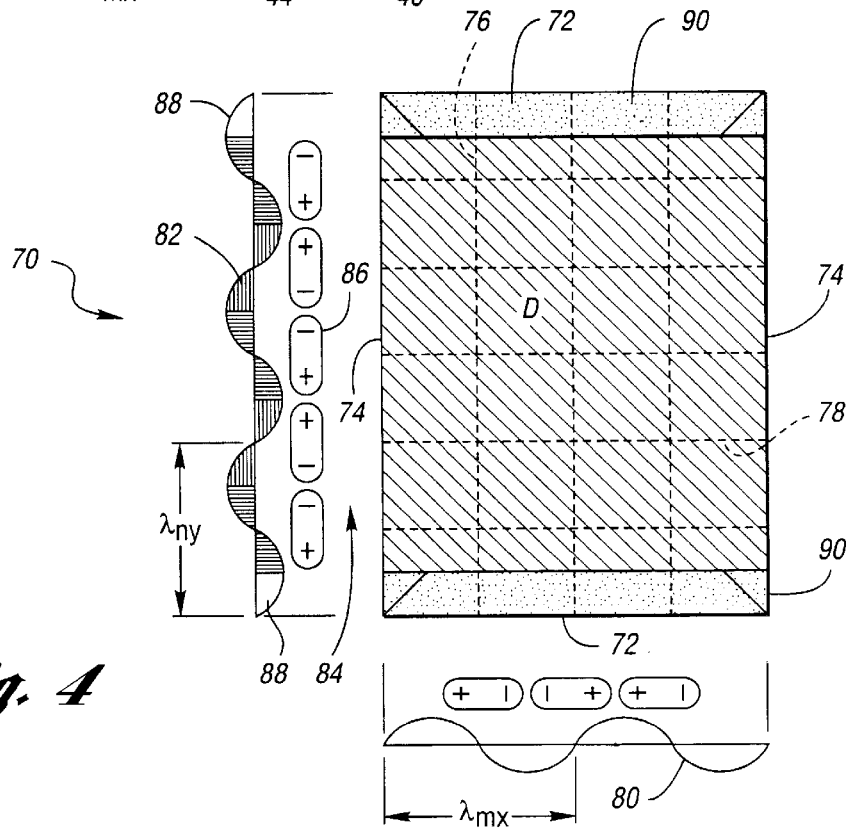
FIG. 4 is a schematic view of a damped structural panel of the present invention, illustrating a supersonic bending wave in the X-direction, and a subsonic bending wave in the Y-direction.

With reference to FIG. 4, a structural panel 70 has Y-direction boundaries at edges 72 and X-direction boundaries at edges 74. The panel 70 is shown in bending mode wmn and the mode shape is indicated by Y-direction node lines 76 and X-direction node lines 78. X-direction bending wave 80 has wavelength $\lambda_{mx}$ and frequency $\omega_{mn}$ corresponding to bending mode $w_{mn}$. In the exemplary bending mode illustrated, m=4 and n=6. In contrast to panel 30 (FIG. 3) in which X-direction bending wave 40 (FIG. 3) is subsonic, X-direction bending wave 80 (FIG. 4) is supersonic.

With continuing reference to FIG. 4, X-direction bending wave 80 has a phase velocity greater than the speed of sound through the surrounding medium. It is to be understood that for exemplary purposes, panel 70 is configured such that bending mode w46 is supersonic in the X-direction and subsonic in the Y-direction. Further, it is to be understood that panel 70 may be configured such that a number of different bending modes are subsonic along one axis and supersonic along the other axis, and that $w_{46}$ may or may not be included as one of those modes. Because bending wave 80 is supersonic, the positive and negative pressure variations due to bending wave 80 alone do not have sufficient time to cancel each other prior to a 180° phase shift in bending wave 80.

Y-direction bending wave 82 is subsonic and has wavelength $\lambda_{ny}$, and corresponding frequency $\omega_{mn}$. Positive and negative pressure variations, generally indicated at 84, due to bending wave 82, form pressure pulse pairs 86. The pressure pulse pairs 86 substantially cancel before the bending wave 82 undergoes a 180° phase shift to radiate the pressure waves. The pressure wave pairs 86 are canceled throughout region D. The cancellations significantly attenuate noise from all anti-nodes defined by Y-direction node lines 76 and X-direction node lines 78 within region D, including noise from supersonic bending wave 80.

Together, supersonic bending wave 80 in the X-direction, and subsonic bending wave 82 in the Y-direction severely attenuate pressure variations about the panel surface except for along the panel Y-direction boundary edges 72 which are parallel to the supersonic bending wave 80, outside region D. Thus, embodiments of the present invention appreciate that sound radiation from mechanically excited structural panels is mostly due to uncanceled quarter wavelengths 88 along a pair of opposite panel edges 72, when there are supersonic bending waves parallel to those edges, and subsonic bending waves normal to those edges. Such bending modes are called edge modes. In accordance with the present invention, viscoelastic material 90 is applied within a limited area along edges 72 of panel 70 to damp sound radiation outside of region D.

Figure 5:
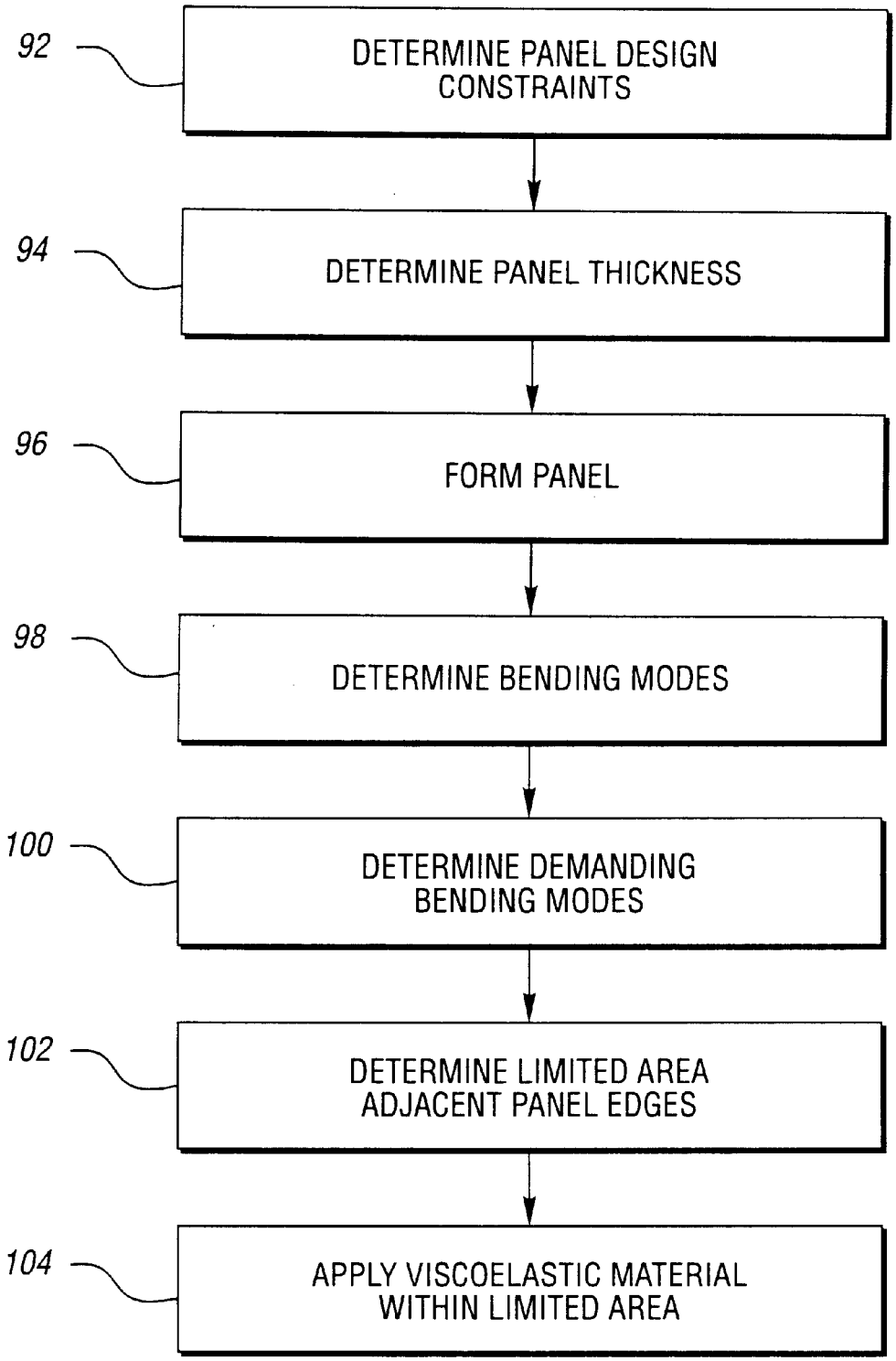
FIG. 5 is a block diagram illustrating a method of the present invention for making a damped structural panel having viscoelastic material within a limited area adjacent to the panel edges.

Referring to FIG. 5, a method of the present invention for forming a damped structural panel having viscoelastic material applied within a limited area adjacent to the panel edges will now be described. At block 92, panel designed constraints are determined. The structural panel may have a variety of predetermined design constraints, such as a predetermined shape. Further, panel design constraints may include a maximum panel weight which places an upper bound on panel thickness, and a strength requirement which places a lower bound on panel thickness. At block 94, panel thickness is determined. In accordance with the present invention, panel thickness is preferably sized such that the first bending mode, $w_{11}$, has a natural frequency of less than about 50 Hertz. The reduced panel thickness is based on the design constraints so as to reduce panel weight while maintaining sufficient strength. Panels may be configured, depending on design constraints, with such reduced thickness that the natural frequency of bending mode $w_{11}$ is only a few Hertz. At block 96, the panel is formed, and preferably is configured such that the panel coincidence frequency is at least 6,000 Hertz.

It is desirable to configure the panel including panel shape, size, thickness, and material such that the first bending mode has a low frequency and the coincidence frequency is high enough to provide a wide range of useable frequencies during use of the structural panel. At step 98, bending modes of the panel are determined analytically based on panel configuration and/or experimentally. At step 100, important or demanding bending modes are determined. These demanding bending modes are those bending modes which have subsonic bending waves along one or both axes, and which radiate sufficient sound power to require damping treatment. The threshold value for sound power at which damping treatment is required may vary based on the application for the panel.

At step 102, a limited area adjacent to the panel edges is determined based on the demanding bending modes. The limited area corresponds to quarter wavelengths of bending waves in the demanding bending modes. At step 104, viscoelastic material is applied within the limited area. As best shown in FIG. 3, viscoelastic material may be applied at corners of the panel when only subsonic bending waves in both the X and Y-directions are expected. As best shown in FIG. 4, viscoelastic material may be applied along entire edges when supersonic bending waves are expected parallel to those edges, and subsonic bending waves are expected normal to those edges.

As best shown in FIG. 2, preferably the viscoelastic material is applied along all of the panel edges to provide damping under a variety of vibratory conditions. The viscoelastic material preferably has increasing thickness toward the panel edges, and extends inward from each panel edge for slightly more than one-fourth of the maximum wavelength for bending waves normal to that panel edge in the demanding bending modes.

Embodiments of the present invention provide significant reductions in the sound power radiated from structural panels by utilizing comer damping and edge damping. Finite element analysis of a flat panel with edge damping along all edges showed a 5 to 12 decibel attenuation in the 500–4,000 Hertz range. Physical testing also showed significant reductions in panel sound power radiation.

It is to be appreciated that the limited area about the panel edges to which the viscoelastic material is applied may be increased to effectively damp lower modes of vibration, at the expense of added panel weight. Further, it is to be appreciated that the limited area may be reduced to decrease panel weight, while providing sufficient sound radiation damping at higher modes of vibration.

While embodiments of the invention have been illustrated and described, it is not intended that such disclosure illustrate and describe all possible forms of the invention. It is intended that the following claims cover all modifications and alternative designs, and all equivalents, that fall within the spirit and scope of this invention.

What is claimed is:

1. A damped structural panel comprising:

a panel with edges, the panel having bending modes including demanding bending modes which have subsonic bending waves along at least one axis, and which require damping treatment based on sound radiation properties of the panel; and a viscoelastic material applied within a limited area adjacent to the panel edges based on the demanding bending modes, the viscoelastic material damping sound radiation caused by bending waves in the demanding bending modes, wherein the limited area is defined by maximum wavelengths for bending waves normal to the panel edges in the demanding bending modes, the limited area extending inwardly from each panel edge for at least about one-fourth of the maximum wavelength for the bending waves normal to that panel edge.

2. The structural panel of claim 1, wherein the panel has a thickness sized such that a first bending mode of the panel has a natural frequency of less than about 50 Hertz.

3. The structural panel of claim 2 wherein the panel is configured such that a coincidence frequency of the panel is at least about 6,000 Hertz.

4. An aircraft comprising:

a body composed of structural panels;

wings connected to the body for providing lift; and a thrust device for providing driving force during operation of the aircraft, wherein at least one of the body structural panels includes a panel with edges surrounding a central portion and having bending modes including demanding bending modes which have subsonic bending waves along at least one axis, and which require damping treatment based on sound radiation properties of the panel, and a viscoelastic material applied within a limited area adjacent to the panel edges and defined by the demanding bending modes, the viscoelastic material limited application area being defined such that the central portion of the panel is substantially void of viscoelastic material, the material damping sound radiation caused by bending waves in the demanding bending modes of the panel during operation of the aircraft.

5. The aircraft of claim 4 wherein the panel has a thickness sized such that a first bending mode of the panel has a natural frequency of less than about 50 Hertz.

6. The aircraft of claim 5 wherein the panel is configured such that a coincidence frequency of the panel is at least about 6,000 Hertz.

7. A method of making a damped structural panel, the method comprising:

forming a panel with edges, the panel having bending modes including demanding bending modes which have subsonic bending waves along at least one axis, and which require damping treatment based on sound radiation properties of the panel;

determining maximum wavelengths for bending waves normal to the panel edges in the demanding bending modes; and determining a limited area adjacent to the panel edges as extending inwardly from each panel edge for at least about one-fourth of the maximum wavelength for the bending waves normal to that panel edge; and applying a viscoelastic material within the limited area to damp sound radiation caused by bending waves in the demanding bending modes.

8. A method of making a damped structural panel, the method comprising:

determining panel design constraints for panel shape, weight, and strength;

determining a panel thickness based on the panel design constraints so as to reduce weight while maintaining sufficient strength;

forming a panel based on the panel design constraints and the panel thickness, the panel having edges;

determining bending modes of the panel including demanding bending modes which have subsonic bending waves along at least one axis, and which require damping treatment based on sound radiation properties of the panel;

determining a limited area adjacent to the panel edges based on the demanding bending modes; and applying a viscoelastic material within the limited area to damp sound radiation caused by bending waves in the demanding bending modes.

9. The method of claim 8 wherein the panel has corners, and wherein applying a viscoelastic material further comprises:

applying the viscoelastic material at the corners of the panel.

10. The method of claim 8 wherein applying a viscoelastic material further comprises:

applying the viscoelastic material along all of the panel edges.

11. The method of claim 8 wherein determining a panel thickness further comprises:

determining the panel thickness such that a first bending mode of the panel has a natural frequency of less than about 50 Hertz.

12. A method of making a damped structural panel, the method comprising:

determining panel design constraints for panel shape, weight, and strength:

determining a panel thickness based on the panel design constraints so as to reduce weight while maintaining sufficient strength;

forming a panel based on the panel design constraints and the panel thickness, the panel having edges;

determining bending modes of the panel including demanding bending modes which have subsonic bending waves along at least one axis, and which require damping treatment based on sound radiation properties of the panel;

determining a limited area adjacent to the panel edges based on the demanding bending modes; and applying a viscoelastic material within the limited area to damp sound radiation caused by bending waves in the demanding bending modes such that the viscoelastic material has a thickness which increases towards the edges of the panel.

* * * * *